United States Patent [19]

Witt et al.

[11] Patent Number: 4,702,534

[45] Date of Patent: Oct. 27, 1987

[54] WINGED DISPLAY CASE

[76] Inventors: Henry C. Witt; Myong C. Witt, both of 910 Spring Valley Rd, Apt. #104, Richardson, Tex. 75080

[21] Appl. No.: 776,417

[22] Filed: Sep. 16, 1985

[51] Int. Cl.[4] ..... A47F 3/00

[52] U.S. Cl. ..... 312/114; D6/302; D6/442; 40/155; 312/138 A; 312/280

[58] Field of Search ..... 312/280, 282, 117, 126, 312/128, 114, 138 A, 290, 324, 227; 206/45.31, 45.34; 40/155, 160; 52/79.9; D6/300, 301, 302, 308, 309, 442, 455, 488, 472; 248/231

[56] References Cited

U.S. PATENT DOCUMENTS

| | | | |
|---|---|---|---|
| Re. 7,371 | 10/1876 | Maginn | 206/45.31 |
| D. 31,482 | 8/1899 | Maurer | 312/128 X |
| 157,037 | 11/1874 | Switzer | 312/280 X |
| D. 244,980 | 7/1977 | Kippenbrock et al. | D6/455 |
| D. 255,306 | 6/1980 | Jacoby et al. | D6/302 |
| 293,028 | 2/1884 | Hyndman | 312/114 X |
| 402,151 | 4/1889 | Fain et al. . | |
| 498,804 | 6/1893 | Manning . | |
| 766,873 | 8/1904 | McElhenie | 312/280 |
| 987,305 | 12/1910 | Keppel | 312/117 |
| 1,104,297 | 7/1914 | Gurley | 312/114 |
| 1,342,477 | 6/1920 | Walas | 40/155 |
| 1,597,834 | 8/1926 | Scudder | 312/282 X |
| 1,745,593 | 2/1930 | Adams . | |
| 2,201,251 | 5/1940 | Patten | D6/301 X |
| 2,764,461 | 9/1956 | Montgomery | 312/114 |
| 3,794,828 | 2/1974 | Arpino | D6/308 X |
| 4,001,987 | 1/1977 | Coulthard | 248/231 X |
| 4,182,061 | 1/1980 | English | 206/45.34 X |
| 4,250,640 | 2/1981 | Culhane | 40/155 |
| 4,524,867 | 6/1985 | Klein et al. | 206/45.34 X |

FOREIGN PATENT DOCUMENTS

| | | | |
|---|---|---|---|
| 1350847 | 12/1963 | France | 206/45.34 |
| 2444422 | 8/1980 | France | 312/138 A |
| 1027917 | 4/1966 | United Kingdom | 40/159 |

*Primary Examiner*—Kenneth J. Dorner
*Assistant Examiner*—Thomas A. Rendos
*Attorney, Agent, or Firm*—Warren H. Kintzinger

[57] ABSTRACT

A display case having a center enclosure, suited for containing trophies and/or other memorabilia, equipped with hinge mounted opposite glass faced picture mounting wings. The center enclosure is any of many different shapes rectangular with a pivot edge opening top, triangular with a removable top, cylindrical, oval or octagonal. Some of the enclosures may be opened from the front instead of the top or from the back. In any event items may be placed on display in the case center enclosure and pictures related to items displayed may be mounted behind glass in the opposite side wings.

1 Claim, 11 Drawing Figures

Figure 1:
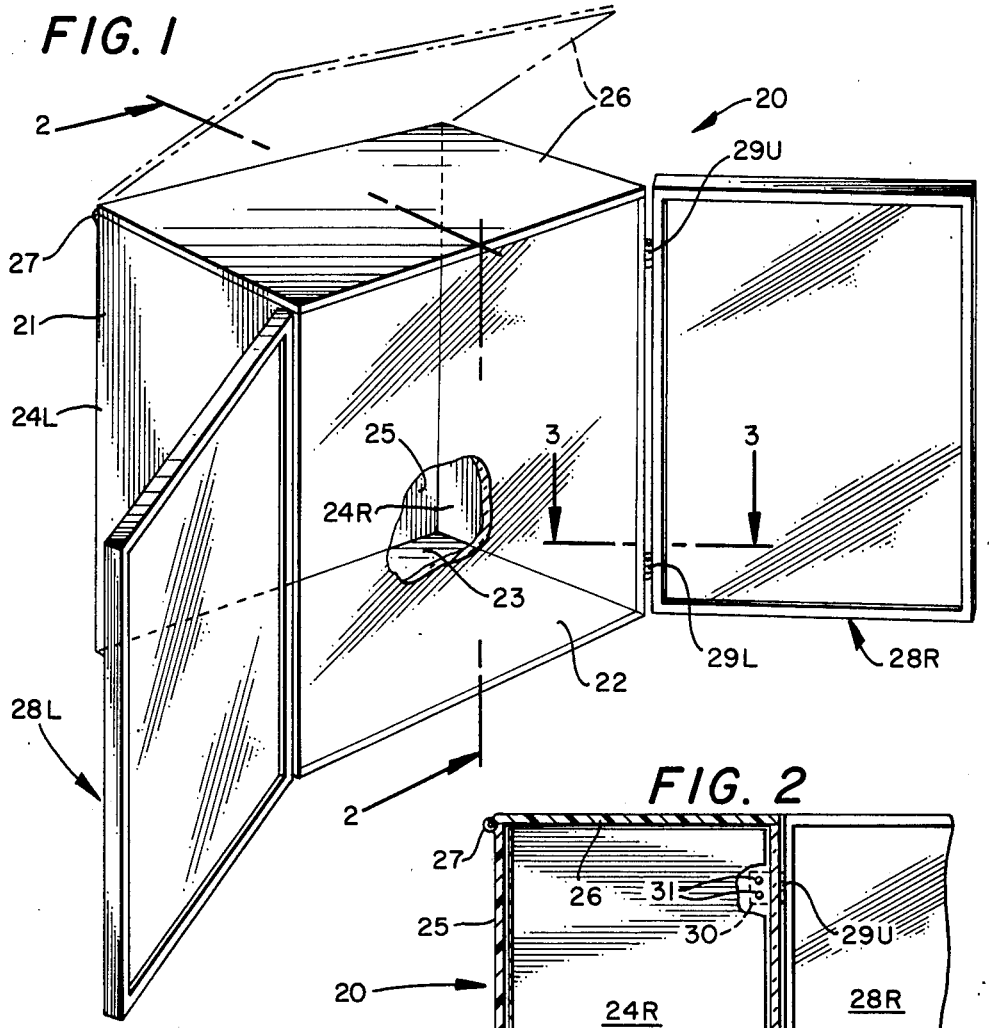

FIG. 4
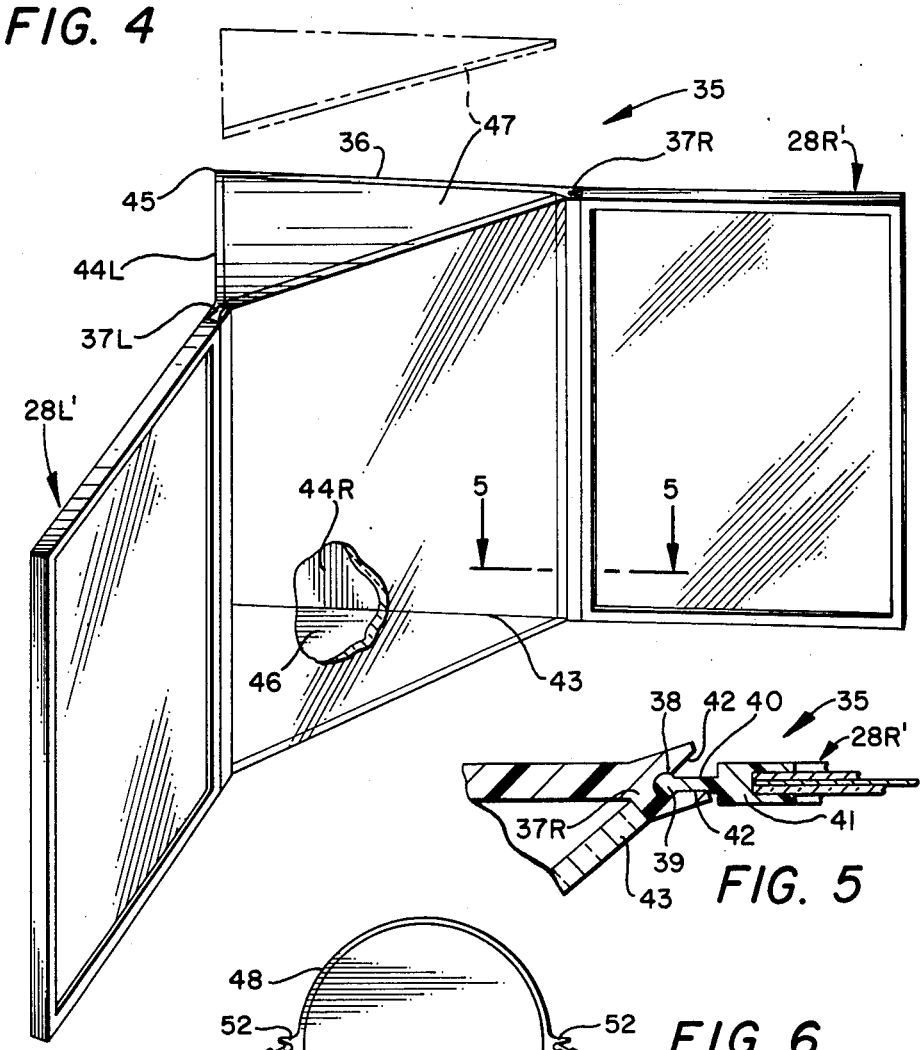
FIG. 5
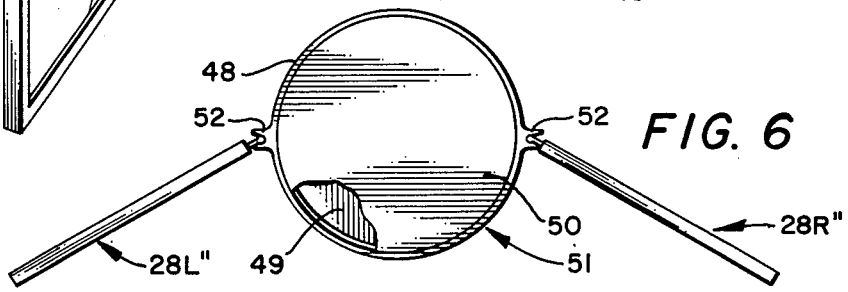
FIG. 6
FIG. 7
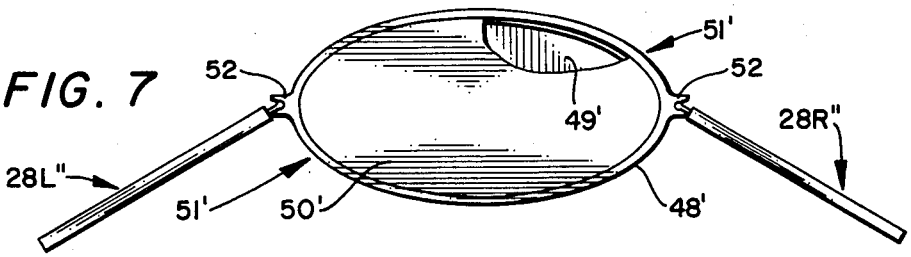

WINGED DISPLAY CASE

This invention relates in general to display cases, and more particularly, to a display container, or case, having opposite side hinge mounted picture displaying wing panels.

There are many interesting occasions, sporting events and accomplishments, family gatherings, weddings and other events, education and recognitions and graduations, and other diverse events generating trophies, awards, medals, artistic sculpturing and other memorabilia. Such articles could be displayed in a window faced box or display case where they are protected while being aesthetically displayed. Along with the events generating the ocassions for creation of such articles to be displayed many times there are photographs taken or pictures rendered associated with articles to be displayed and it would be desirable to be able to show both articles and event related photographs together for the enjoyment of one and all.

It is therefore a principal object of this invention to provide a display container, for displaying articles, equipped with picture mounting opposite side panels.

Another object is to provide such a display container having a front windowing and pivotally mounted side panels.

Still another object is to provide such a display container with opening means for changing or adjusting times being displayed.

Features of the invention useful in accomplishing the above objects include, in picture mounting wing panel equipped display cases, a center display box or case having opposite side pivot hinge mounted picture display wing panels. This is provided as a decorative protective enclosure for articles of sentimental value such as awards and trophies and other memorabilia and the wing panels provide the mounting for display of associated photographs and pictures. While the display case could be provided in a wide range of sizes a typical center container could be ten inches by ten inches in width and height and six inches in depth with the opposite side picture mounting panels pivot hinge mounted at the opposite side corners of the display case box. At least the front of the display case box should be transparent although the entire box could be transparent and in some instances would be. Mounting of the opposite side panels varies in accord with the shape of the center display container that may be rectangular, triangular, cylindrical, oval or octagonal with pivot hinge mountings at the front edges, or rear edges, or a location between the front and rear particularly with cylindrical and oval containers.

Specific embodiments representing what are presently regarded as the best modes of carrying out the invention are illustrated in the accompanying drawings.

Figure 2:
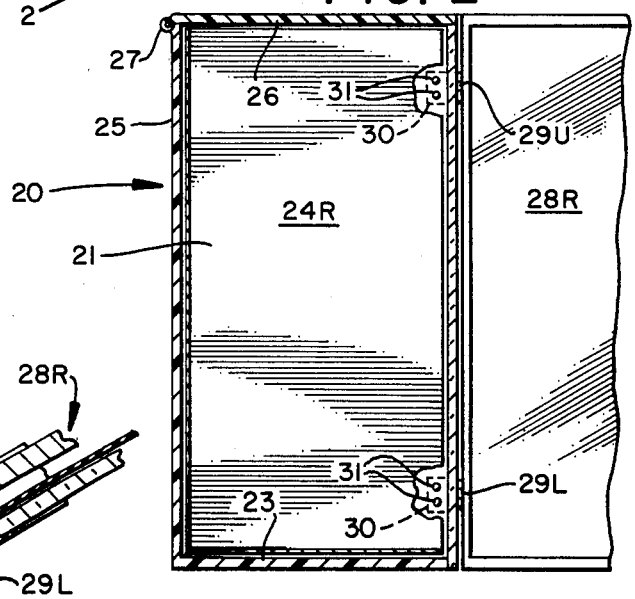
Figure 3:
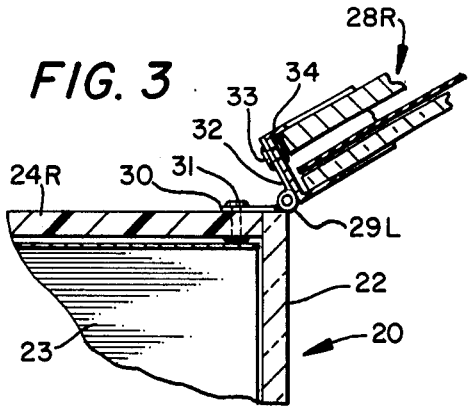
Figure 8:
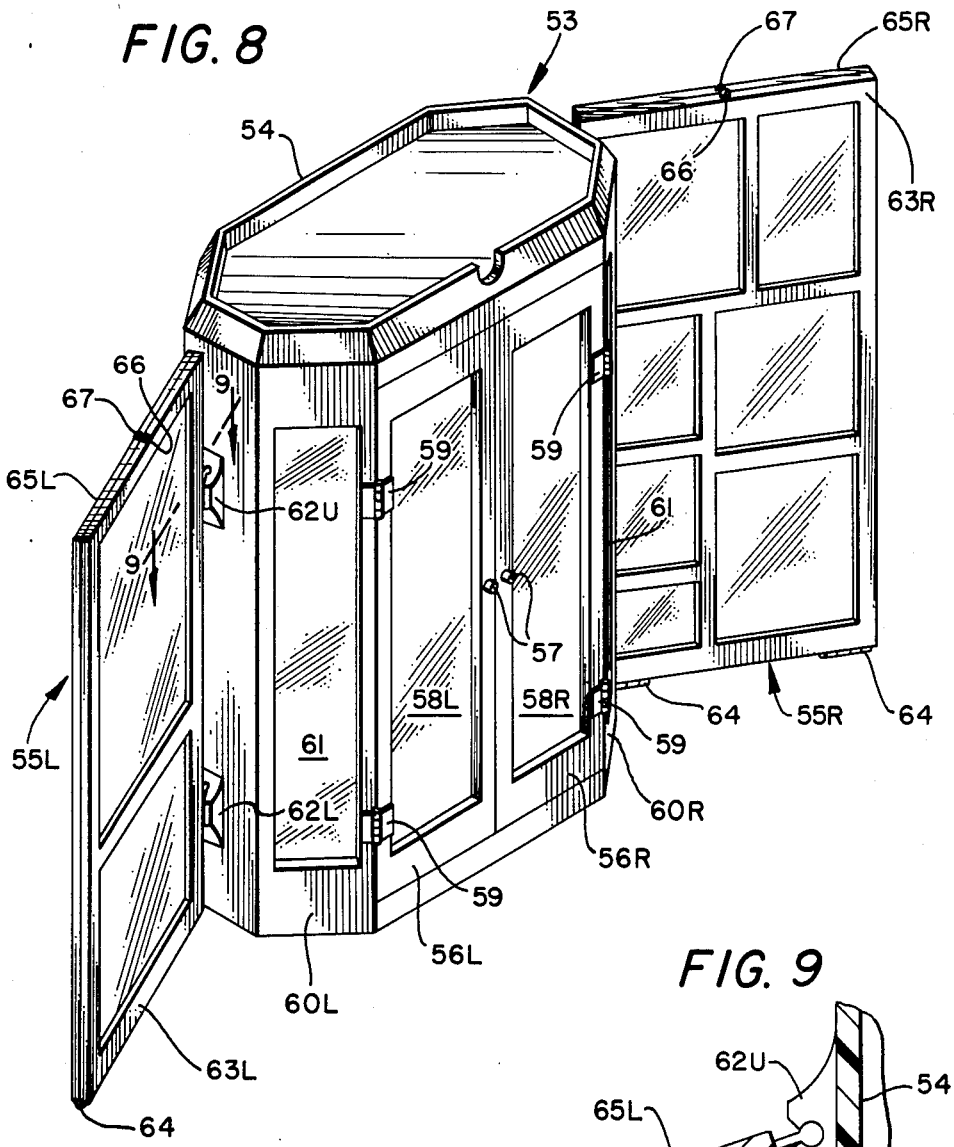
Figure 9:
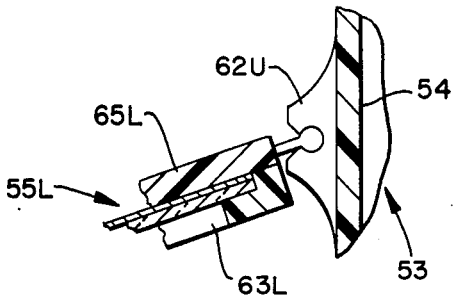
Figure 10:
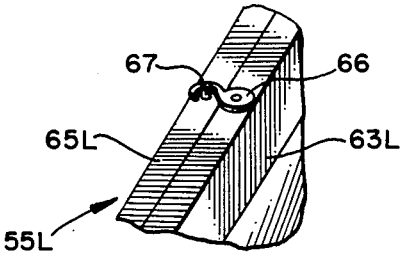

In the drawings:

FIG. 1 represents a perspective view of a rectangular display case equipped with opposite side picture mounting wings;

FIG. 2, a partially cut away and sectioned view taken generally along line 2—2 of FIG. 1 showing case interior and case to wing pivot mounting detail;

FIG. 3, a partially cut away and sectioned view taken along line 3—3 of FIG. 1 showing further wing and wing pivot mounting detail;

FIG. 4, a perspective view of a triangular display case equipped with opposite side picture mounting wings;

FIG. 5, a partial cut away and sectioned view taken along line 5—5 of FIG. 4 showing picture wing and wing pivot mounting detail;

FIG. 6, a top plan view of a cylindrical display case equipped with two opposite side pivotally mounted picture wings;

FIG. 7, a top plan view of an oval shaped display case equipped with two opposite side pivotally mounted picture wings;

FIG. 8, a perspective view of an octagonal display case equipped with opposite side pivotal picture mounting wings;

FIG. 9, a partial cut away and sectioned view taken along line 9—9 of FIG. 8 showing picture wing pivot mounting detail;

FIG. 10, a partial enlarged view of a picture wing top closing latch; and

Figure 11:
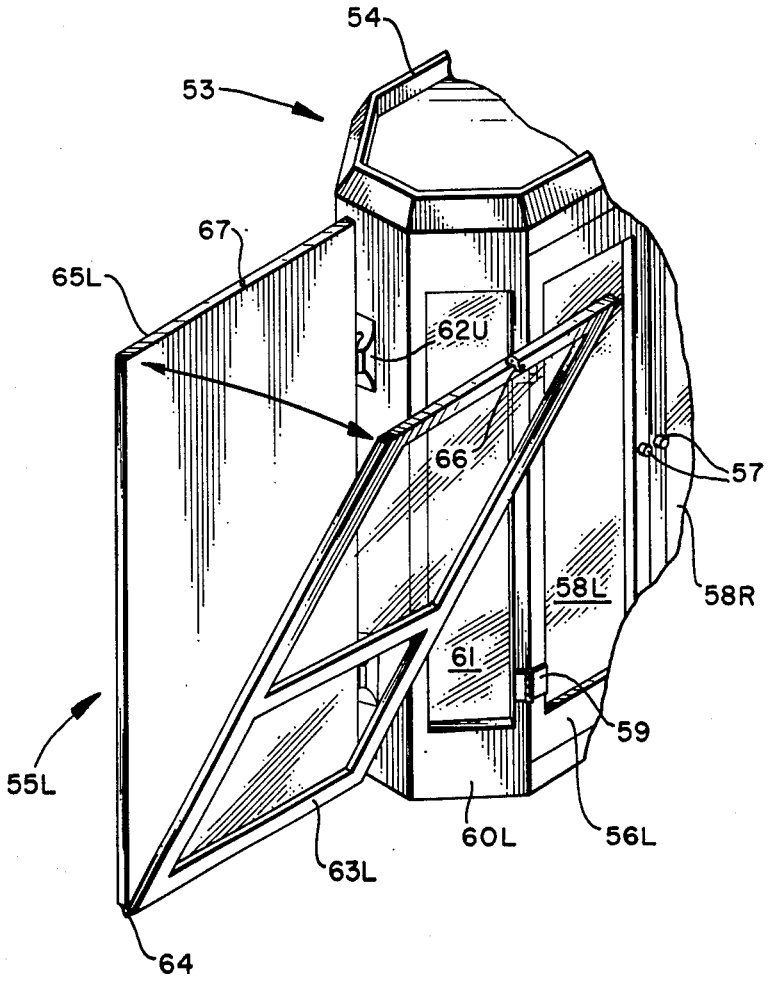

FIG. 11, a partial view of the octagonal display case of FIGS. 8, 9 and 10 with a picture wing top closing latch released and the picture wing front pivoted out.

Referring to the drawings:

In the best mode showing of FIG. 1, the display case 20 is shown to be a rectangular box 21 with a transparent front wall 22, a bottom 23, two side walls 24L and 24R, a back wall 25 and a top 26 that is fastened by pivot hinge 27 to the top of back wall 25. Any of the walls in addition to front wall 22 may be made of transparent material if desired or they may be opaque. The display case 20 is also equipped with two opposite side picture displaying panels 28L and 28R that are pivotally mounted to the box 21 at the front covers thereof by upper and lower pivot hinges 29U and 29L for each of the panels 28L and 28R. Picture displaying panels 28L and 28R may be mounted in like manner to the rear corners of box 21 if desired instead of the front mountings shown.

Referring also to FIGS. 2 and 3 the upper and lower pivot hinges 29U and 29L for each of the panels 28L and 28R include a pivot hinge flange 30 fastened by bolt and nut assemblies 31 to the respective side wall 24L or 24R and a pivot hinge flange 32 fastened by screws 33, or rivets or bolts, to the adjacent frame edge 34 of the respective wing panel 28L or 28R. With the display case 20 embodiment of FIGS. 1, 2 and 3 the wing panels 28L and 28R are picture frames that if dismounted from the box 21 may be used as wall mountable and/or stand alone picture frames. Thus, a display case 20 is provided with the center box 21 providing a decorative protective enclosure for articles of sentimental value such as awards and trophies and other memorabilia that may be placed in the box 21 with top 26 pivoted up. Pictures, event related to the article(s) placed in the center box 21, are mounted in the picture displaying panels 28L and 28R so as to enhance the aesthetics of the overall display.

Referring now to FIG. 4 a winged triangular case 35 is shown that has a triangular center case 36, in place of the rectangular box 21 of the FIGS. 1-3 embodiment, with picture displaying panels 28L' and 28R' pivotally mounted at the opposite side apex corners 37L and 37R of the case 36. Referring also to FIG. 5 the pivotal interconnection between the triangular center case 36 and each of the panels 28L' and 28R' is a round socket or cylindrical socket 38 and ball or rod 39 articulating interconnect with stem 40 of the ball or rod connected to the adjacent frame edge 41 of the respective picture displaying panel 28L' or 28R'. The round or cylindrical socket 38 located on and along opposite side apex corners 37L and 37R have cut back angled surfaces 42 at the socket opening permitting limited pivotal articulation of the picture displaying panels 28L' and 28R' relative to the vertically extended triangular center case 36. The triangular center case 36 has a transparent front wall 43 left and right side walls 44 and 44R that extend back to a rear apex 45, a bottom 46 and a removable top 47 that may be lifted away for access to the interior of the case 36.

The embodiments of FIGS. 6 and 7 are quite similar. The embodiment of FIG. 6 employs a vertical cylinder 48 of transparent material with a bottom 49 and a removable top 50 as a display case 51 mounting two opposite side picture displaying panels 28L" and 28R". The pivot hinge 52 mounting of panels 28L" and 28R" may be quite similar to those used with the display case 35 of FIG. 4 as detailed in FIG. 5 or another hinge interconnect mounting structure. The display case 51' of FIG. 7 is a vertical oval 48' of transparent material having a bottom 49' and a removable top 50' with pivot hinge 52 mounting of opposite side picture displaying panels 28L" and 28R" the same as with the embodiment of FIG. 6.

Referring now to the octagonal display case 53 of FIGS. 8–11 the octogonal display cabinet 54 is equipped with pivotally mounted opposite side picture mounting wing panels 55L and 55R. The display cabinet 54, that is generally larger than the cases of the other embodiments, has two front opposite side doors 56L and 56R with knobs 57, windows 58L and 58R and upper and lower mounting hinges 59. Opposite side octagonal angled faces 60L and 60R are also provided with windows 61 for viewing articles placed on shelves within the display cabinet 54. Referring also to FIG. 9 upper and lower pivot hinge mountings 62U and 62L for opposite side picture mounting wing panels 55L and 55R. These panels 55L and 55R as larger panels are each subdivided into a plurality of windowed picture frames in frame fronts 63L and 63R that are pivot hinged 64 at the bottom to the panel backs 65L and 65R. The tops of the frame fronts 63L and 63R and the panel backs 65L and 65R are provided with hook 66 and pin 67 fasteners, as shown in embodiment detail in FIG. 10, that when unfastened permit the frame fronts 63L and 63R to pivot out and away from panel backs 65L and 65R respectively for picture mountings access or replacement access.

Whereas this invention has been described with respect to several embodiments thereof, it should be realized that various changes may be made without departure from the essential contributions to the art made by the teachings hereof.

We claim:

1. A display case structure comprising: an enclosure with a transparent front section and suited for containing memorabilia; wing means mounted on and extended to the side from said enclosure; and said wing means including a planar area for the mounting of pictures thereon that may be related to items displayed within said enclosure; wherein said wing means is pivotally mounted on said enclosure; said wing means is two opposite side wing panels; and said enclosure is a center enclosure; said center enclosure is an octagonal cabinet; wherein said octagonal cabinet is equipped with two opposite direction opening front doors with windows in each door; said octagonal cabinet has two opposite side octagonal angle faces also provided with windows for the viewing of articles placed within the octagonal cabinet; said octagonal cabinet has opposite side end faces mounting said two opposite side wing panels; said two opposite side wing panels are each subdivided into a plurality of windowed picture frames; said wing panels each have panel frame fronts subdivided into multiple picture frame sections and panel backs with the bottom of said panel frame fronts pivotally connected to the bottom of said panel backs; and wherein the tops of said panel frame fronts and said panel backs are provided with latch means that when unlatched permit the panel frame fronts to pivot out and away from said panel backs for picture mounting access.

* * * * *